United States Patent [19]

Pasini, III et al.

[11] 3,933,447

[45] Jan. 20, 1976

[54] UNDERGROUND GASIFICATION OF COAL

[75] Inventors: Joseph Pasini, III; William K. Overbey, Jr., both of Morgantown, W. Va.; Charles A. Komar, Uniontown, Pa.

[73] Assignee: The United States of America as represented by the United States Energy Research and Development Administration, Washington, D.C.

[22] Filed: Nov. 8, 1974

[21] Appl. No.: 522,170

[52] U.S. Cl. ..... 48/210; 48/DIG. 6; 166/259; 166/256; 299/2

[51] Int. Cl.[2] ..... C10J 5/00; E21C 43/00

[58] Field of Search ..... 48/210, DIG. 6; 166/256, 166/257, 259; 299/2, 3

[56] References Cited

UNITED STATES PATENTS

| | | | |
|---|---|---|---|
| 1,913,395 | 6/1933 | Karrick | 48/DIG. 6 |
| 3,024,013 | 3/1962 | Rogers et al. | 166/256 |
| 3,497,335 | 2/1970 | Taylor | 48/210 X |
| 3,563,606 | 2/1971 | Sears | 299/2 |
| 3,765,722 | 10/1973 | Crumb | 299/2 |
| 3,775,073 | 11/1973 | Rhoades | 48/210 |

*Primary Examiner*—R. E. Serwin

*Attorney, Agent, or Firm*—Dean E. Carlson; Richard A. Lambert

[57] ABSTRACT

There is disclosed a method for the gasification of coal in situ which comprises drilling at least one well or borehole from the earth's surface so that the well or borehole enters the coalbed or seam horizontally and intersects the coalbed in a direction normal to its major natural fracture system, initiating burning of the coal with the introduction of a combustion-supporting gas such as air to convert the coal in situ to a heating gas of relatively high calorific value and recovering the gas. In a further embodiment the recovered gas may be used to drive one or more generators for the production of electricity.

12 Claims, 5 Drawing Figures

UNDERGROUND GASIFICATION OF COAL

BACKGROUND OF THE INVENTION

1. Field of the Invention

This invention relates to the in situ or underground gasification of coal by drilling boreholes into the major fracture system of the coal, igniting the coal and recovering the gas formed.

2. Description of the Prior Art

In 1971, more than 75 percent of the energy used in the United States came from petroleum and natural gas. Coal, which is our most abundant energy resource, supplied only 18 percent of the total energy consumed in that year. The increasing short supply of petroleum and natural gas has caused many people in the energy field to consider various methods of converting our vast coal reserves to an environmentally acceptable fuel.

Coal gasification has become the subject of many studies in recent years as a conversion technique which shows promise of providing a substitute for high Btu natural gas. Such a substitute gas would have its greatest impact on the industrial sector, primarily in the electric power generation field. Low Btu gas can be produced from coal either above ground or in place.

Since 1969, with the passage of the Federal Coal Mine Health and Safety Act, the Bureau of Mines has increased its emphasis on reducing the occupational hazards associated with coal mining. The in situ gasification of coal has therefore become a possible means of extracting energy value from coal while minimizing health and safety problems.

The production of coal energy by the use of wells through underground mining has been a continual subject of interest in the field of energy production for many years. Coal gasification by use of above ground retorting is well known in the art and was developed in Germany prior to World War II. In this method, oxygen and steam are simultaneously injected into a field retort and upon combustion, a gas having a calorific value sufficient for commercial usage and coal tar liquids is produced.

Various ideas have been advanced for conducting the gasification of coal underground or in situ, that is, to convert the coal "in place" to a usable gas having a high calorific value. Many technological advances were made in this area and efforts were primarily confined to the advancement of theories on the subject until substantial work and testing was done in Russia. Much of the Russian work involved considerable underground mining and construction in an effort to provide the necessary passageways for air to pass through the coal. Some efforts involved breaking up the coal underground to provide air passages but the problem with the Russian approach was that the numerous wells required to break up the coal underground and provide adequate air passages made the approach uneconomical as the amount of excavation encountered was tremendous.

The art then progressed to drilling holes in the coal seam and charging with dynamite. As the burning front progressed through the stratum the charges were automatically set off in an effort to break off and crush the coal and render a segment of the bed more permeable. This resulted in irregularities too great to sustain continued gas flow and the gas produced contained such large amounts of air that the heating value of the gas was lowered substantially.

A further approach involved shaft and borehole mining combinations but these progressed only to the point that steeply sloping seams near outcrops could be utilized to provide a useful gas. A major problem with this system as well as the previous systems discussed involved the large amount of excavation and mining required as well as the further problem that the rate of air injection which directly affected the gas produced was responsible for providing a gas of low Btu value. The low permeability of the coal contributed to this problem.

A good deal of prior art has been written on this subject matter and various aspects of in situ gasification of coal are disclosed in recently issued U.S. patents. Patents which are concerned with this subject matter include U.S. Pat. Nos. 3,563,606; 3,513,913; 3,628,929; 3,709,295 and 3,775,073. In addition, a publication of the Bureau of Mines of the United States Department of Interior, Information Circular 8193, issued 1963, contains a bibliography of the underground gasification of coal for the period 1945–1960.

The present invention is considered to provide a number of advantages in new methods for the in situ gasification of coal and to provide a major advance in this art.

SUMMARY OF THE INVENTION

It is accordingly one object of the invention to provide a method for the in situ gasification of coal to provide a heating gas of high Btu value.

A further object of the invention is to provide a method by which the in situ gasification of coal can be carried out to provide increased conversions of the coal and achieve maximum penetration of the coal by taking advantage of its area of greatest natural permeability.

A still further object of the invention is to provide a method for the in situ conversion of coal to a heating gas of high calorific value by use of the horizontal borehole method in which a minimum number of boreholes are required to be drilled.

A still further object of the invention is to provide a method for the in situ gasification of coal for conversion of a substantial portion of the coal into a heating gas of high calorific value by methods which provide maximum fracture and permeability of the gas into the coalbed together with methods for recovery of the product gas produced.

Other objects and advantages to the present invention will become apparent as the description thereof proceeds.

In satisfaction of the foregoing objects and advantages there is provided by this invention a method for the in situ gasification of coal which comprises drilling at least one well or borehole from the surface of the earth so that it enters the coalbed or seam horizontally and intersects the major fracture system of the coalbed, initiating burning of the coal while introducing a combustion-supporting gas such as air to convert the coal in situ to a gas of relatively high calorific value and recovering the gas produced. In a further embodiment the gas recovered may be used to drive one or more generators for the production of electricity.

BRIEF DESCRIPTION OF THE DRAWINGS

Reference is now made to the drawings accompanying this application where it will be seen that, FIG. 1 represents a schematic diagram of one embodiment of directional drilling of the boreholes according to the method of this invention.

DESCRIPTION OF PREFERRED EMBODIMENTS

Figure 1:
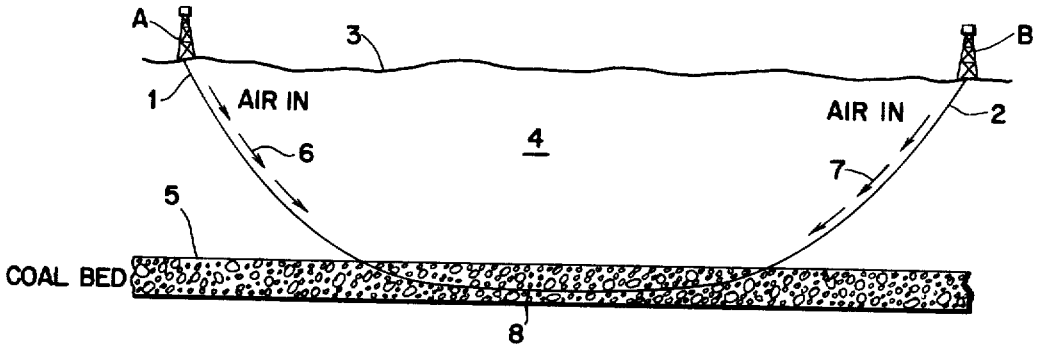

As indicated above, this invention is concerned with new methods for the in situ gasification of coal. The method of the present invention utilizes a combination of procedures and techniques which provide a novel advance in the gasification of coal in place. In one aspect use is made of boreholes or wells drilled from the earth's surface and preferably drilled on a slant so as to intersect the coalbed while traveling in a horizontal direction. Use is also made of the discovery that maximum permeability of coal is achieved by drilling the boreholes parallel to the direction of lowest permeability so that air to support the combustion and the product gases will travel in the direction of greatest permeability at right angles toward the producer borehole. Using these techniques it has been found that major advantages are achieved over the use of vertical wells or blind boreholes which provided insufficient exposed area to sustain a quality product gas. Moreover, the number of wells required to develop coal resources can be considerably reduced over the systems used heretofore. Various advantages are achieved in use of the methods of this invention including the burning of coal in the natural fracture system over large areas, control of the burning operation over the entire life of the burn, as by the use of water and polymer quenching, reduction of the number of wells necessary to be drilled to accomplish the in situ gasification to at least 2% of the number now required, drilling of the wells from a surface location beginning vertically or at some predetermined angle but passing through the coal horizontally and back to the surface vertically or at some angle at a point many hundreds of feet away, and the use of positive and negative quencher wells to improve the recovery of gases generated. In addition, large blocks of coal (e.g. 2,400 to 4,000 feet long by 200 to 1,000 feet wide), can be burned between each injection without additional wells. Also subsidence, if it occurs will be over a very large area to result in a more environmentally acceptable operation. Further, the wells can be cased from top to bottom, the quality of the producer gas during devolatilization can be maintained at a higher Btu value, and liquid hydrocarbons will be produced during operation.

The concept as set forth with respect to the method of this invention will produce a gas of a relatively high calorific value, that is, on the order of a Btu value of greater than 400 during devolatilization of the coal and a low Btu value gas greater than 100 during the combustion of the remaining coke.

The wells or boreholes are directionally drilled perpendicular to the direction of maximum permeability and the coal converted to a gas by forward and/or reverse burning utilizing air, oxygen enriched air, or oxygen. Control of the burn (forward or reverse) will be accomplished by air and/or oxygen injection control, the use of water injection, and/or the injection of various polymers. The wells are directionally drilled either continuously (down from surface-through the coal back to surface) or down from the surface, but not returned to the surface (blind end in coal) and can be cased throughout the length. Burning (reverse or forward) is then initiated in the coal and the flame front progresses through the major fracture system and to some degree through the minor fracture system and the gas produced is collected in the production wells and returned to the surface for firing gas turbines and boilers and conversion to methane, methanol or other liquid hydrocarbons.

As indicated this invention is predicated on two primary discoveries. One discovery involves the method by which the boreholes and wells are drilled into the coal seam. The second concerns the method in which the coalbed is fractured in order to obtain greatest permeability of the gas being introduced and thus the greatest conversion.

In drilling the borehole, it is preferable that it be started at any desired angle from vertical and started from the surface. The borehole may be started at any desired angle from vertical so long as the drilling equipment will permit the borehole to be traveling horizontally when it reaches the coalbed or seam. In general, however, with conventional equipment the angle of initiation will be determined by the depth of the coalbed and dip of the coalbed. With conventional angle drilling rigs the angle of deviation should increase at a uniform rate of 5° per 100 feet of drilled hole for maximum benefits.

A preferred embodiment utilizing the slant drilling concept is illustrated in FIG. 1 where there is seen surface 3, overburden 4 which may be rock, clay, subsoil and the like, and coalbed or seam 5. The coalbed may be of varying thickness and depths and many thousands of feet long. From the surface, borehole 1 is drilled by well A on a slant of any desired angle from vertical and then proceeds at a greater slant so that it intersects the coalbed 5 while traveling in a horizontal direction. As seen in the drawing, a second borehole 2 is drilled from well B at a suitable distance from borehole 1 and in a reverse direction so that it will intersect the same coalbed while traveling on the horizontal axis. Thereafter each well is cased into the coalbed or seam and burning of the coal is initiated by establishing in situ combustion within the coalbed 5. To establish combustion, ignition is started and a combustion supporting gas is introduced from borehole 1 in the direction of arrow 6 and in borehole 2 in the direction of arrow 7, the gas being necessary to support combustion of the coal and its conversion.

While the wells or boreholes may be drilled at any desired angle or from vertical, in the preferred embodiment the direction of deviation is determined by the orientation of the natural fracture system existing in the coal. This fracture system controls the directional permeability of the coal and thus the preferential direction of flow of the product gases. Therefore, in the preferred aspect, the directionally deviated wells are drilled parallel to the direction of lowest permeability so that air or other combustion and product gases will travel in the direction of greatest permeability at right angles toward the producer borehole.

In the system of FIG. 1, the combustion may be started in one or both horizontal boreholes. In the seam, either forward or reverse combustion can be accomplished with these two wells or any combination of wells. A reverse combustion process may also be used in which vertical wells are provided to monitor the location of the combustion zone. This may also be done by use of deviating wells which cross the combustion wells at right angles. The gases produced are removed by additional wells or boreholes drilled for that purpose into the coalbed or seam at the point where the gas is produced as is known in the art.

In the underground combustion of coal in general, a production well is provided in a manner so as to be in direct communication with a maximum portion of the coalbed in the area where the gas is to be produced. Casing is barely notched into the coal seam and cemented and the open or uncased hole extends to the bottom of the coalbed. All other strata are cemented and sealed off from the producing wellbore in order that production from the wells must come through the coalbed itself. The production wells may be drilled by procedures well known to the art. Essentially, any well pattern combination with which communication between the wells may be effected may be utilized with the present invention. In addition, the completion technique used may consist of any of the various well isolation methods as long as the coal seam is left undamaged and remains isolated from the overburdened strata.

After the wells or boreholes are drilled, and the vertical fractures opened, an excess of a combustion supporting gas such as air or oxygen, is introduced to form a highly volatile or combustible combination with the hydrocarbons contained within the coal deposit. Ignition of the coal deposit forms a crumbled network of coal in the coal deposit for propagation of a combustion front through the coal seam. The amount of combustion movement is directly proportional to the gas injection rate so that the advancement of the combustion front may be controlled as it moves throughout the coal deposit. The requirement of creating the combustion front is alleviated in that the combustion front is already initiated during the fracture network formation and propagated by the subsequent injection of a second combustion front throughout the coal deposit. It is understood that by any of the processes described, a reverse combustion drive may be induced by reversing injection of the combustible gas into the production wells.

Figure 2:
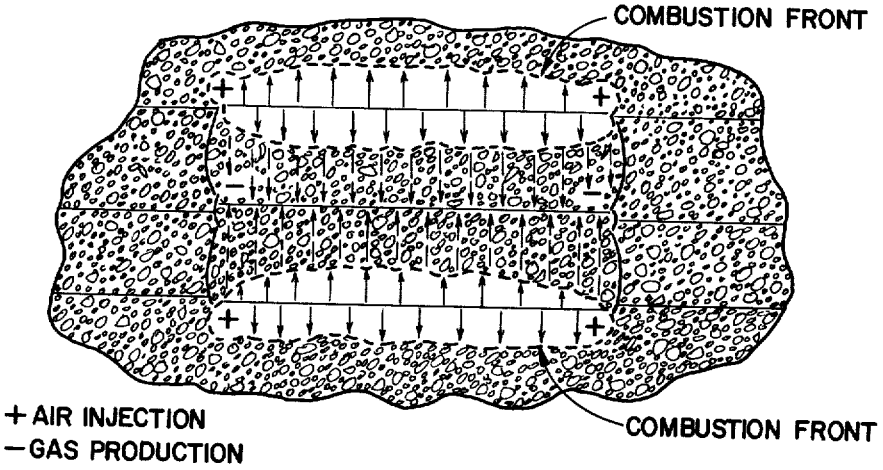
FIG. 2 is a plan view illustrating the combustion front of the burning coal as the in situ conversion progresses.

The burning or combustion of a coal seam according to the present invention is illustrated in FIG. 2 in which there are shown the combustion fronts achieved using this system. Thus, a combustion front is initiated as indicated with the combustion supporting gas such as air being introduced at the (+) side and the gases produced as a result of the combustion being removed from the other or (−) side and removed from the system by production wells. Thus FIG. 2 illustrates the relative positioning of the injection wells and production wells. It will be understood that the combustion zone migrates laterally toward the producing wells.

An important aspect of the present invention resides in the method by which the bed of coal is fractured as this is achieved by the boreholes being drilled and entering the coalbed in the horizontal direction and continuing in that direction. By this invention, maximum permeability of the coal by the combustion front is achieved to provide maximum conversion within the system. Thus the manner in which the coal is intersected provides maximum permeability and thus maximum conversion.

The proper fracturing of the coal according to the present invention depends on determining prior to drilling the natural fracture system of the coal. This is carried out by obtaining one or more oriented cores for study and determination of the major and minor natural fracture systems.

Figure 3:
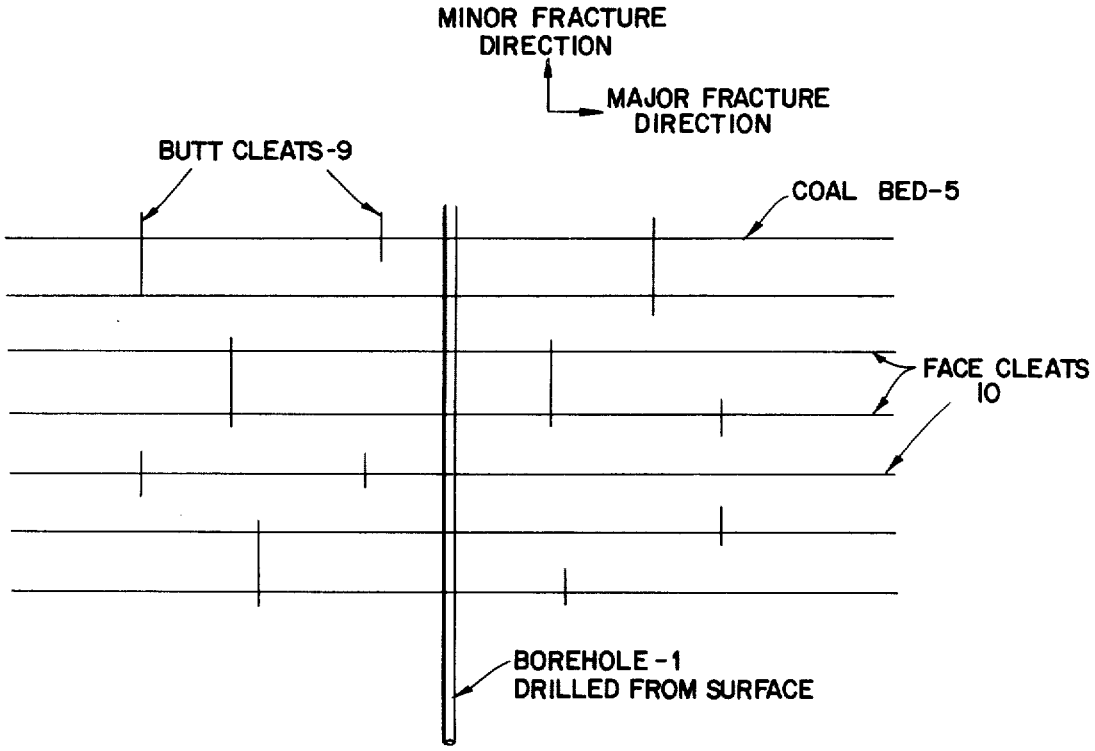
FIG. 3 illustrates the method of intersection of a bed of Eastern coal to achieve communication with the major natural fracture system of the coal and therefore maximum permeability.

The major fracture system of Eastern coal is illustrated in FIG. 3 together with the relating position of a borehole 1 drilled into the coalbed 5 horizontally. Thus coalbed 5 comprises butt cleats 9 lying in one direction and face cleats 10 lying in the perpendicular direction. In Eastern coal, the face cleat or face cleat direction is the direction of the major fracture system while the butt cleat direction is the direction of the minor fracture system. The cleats are not as distinct for Western coal. The spacing of natural fractures may be as close as one inch.

According to this invention the borehole is drilled so as to intersect the major natural fracture system perpendicularly and in a horizontal direction as this has been found to provide maximum permeability. As shown in FIG. 3, borehole 1 intersects face cleats 10 at right angles or perpendicularly, and travels in the same direction or parallel to the butt cleat 9. This direction would be different for Western coal. In FIG. 3, the greatest flow of gases such as methane will be through the face cleat fractures into the horizontal boreholes. Thus, maximum fracture of the coal is obtained.

In order for maximum benefits to be obtained from the invention, it is necessary to determine beforehand the direction of the natural fracture system. It is therefore necessary to conduct directional property studies including orientation of joint strikes, permeability, tensile strength, sonic velocity and inherent rock weakness. The results of these studies, together with geologic structure setting, will lead to an accurate prediction of the gaseous flow path in the coalbed.

Figure 4:
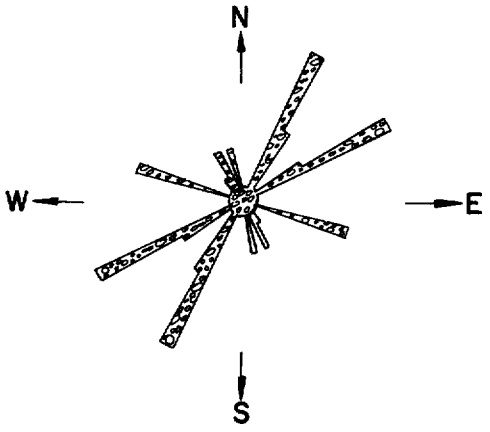
FIG. 4 is an enlarged view of a core sample of coal showing the areas of maximum fracture densities.

Upon receipt of an oriented core, individual pieces are placed in a goniometer and orientation marks are scribed on the core. After each piece has been oriented, measurements are made of the orientations of individual joint strikes that can be seen. Once the natural fractures are delineated, their orientations are measured and their frequency of occurrence is summarized for the entire coalbed formation. Intervals of maximum fracture density may be regarded as zones of weakness which could be extended during stimulation of the coalbed. A specific embodiment is shown of a core sample in FIG. 4. In this sample the intervals are defined as N 20° E and N 60° E. This sample was taken from the Hanna, Wyo. coal field.

Figure 5:
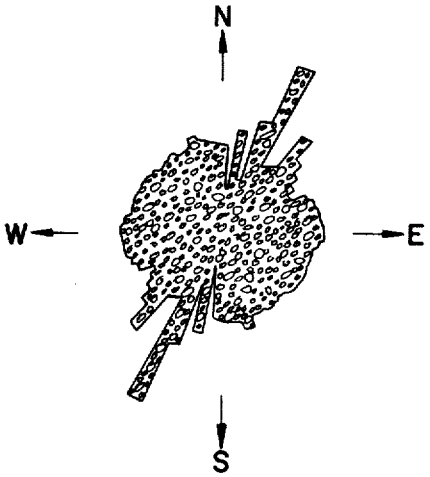
FIG. 5 is an enlarged view of a core sample of coal showing the significant areas of permeability.

Specimens are selected from various sections of the coalbed for measurements of permeability to gas in different directions. Permeability measurements are made in a Hassler cell, using whole core permeability techniques with dry nitrogen as the flow medium. Measurements are made in eight different directions, 22½ degrees apart. Permeability will be observed to be quite directional and statistically significant. A specific example from the Hanna field is shown in FIG. 5. As seen in this sample permeability was significant in the interval N (11° to 56°) E.

Ultrasonic pulse transit time measurements may be made on the same specimens for which permeability is known. Measurements are made at atmospheric pressure using a through transmission arrangement of transducers. The mechanical pulse generated by a 2½ megahertz piezoelectric crystal is transmitted diametrically through the test specimen at a pulse amplitude of 2,200 volts and detected by a receiver transducer. Interval travel time is recorded after 1,000 pulses were counted and averaged by a Hewlett Packard counter timer. Transit time measurements are made at 15° intervals about the circumference of the specimens. Variations with direction are measured and longest transit times confirm the directions of open conduits or directional flow channels.

Since coal has very little tensile strength itself, cylindrical specimens are extracted from the sandstone above the coal and tested to determine if directional variations are indicative of failure planes. Specimens 3 inches in diameter by 1½ inches thick are tested by the line load technique. In this test, specimens are placed on their edge between half cylinders welded to the platens of the loading machine and a compressive load is applied across the diameter. Tensile strength normal to the axis of loading was determined from the magnitude of the applied load at failure by the formula $$S_T = 2\ P/\pi dt$$

where $S_T$ = tensile strength normal to the axis of loading, psi.

$P$ = applied load at failure, lbs.

$d$ = diameter of disk, in.

$t$ = thickness of disk, in.

In this manner, four to eight specimens will be tested for each of 6 directions representing 30° intervals so that a statistical evaluation can be obtained.

To further support the data to determine the direction of drilling, specimens may be taken to determine the point load induced fracture. Here cylindrical specimens having a diameter/thickness ratio of about 2 are tested to define the inherent planes of weakness within the formation. In these tests, a load is applied through the central axis of a disk by a pair of opposing hemispherical indentors until a tensile fracture is induced in the specimen. If the test specimen is a homogeneous isotropic material, random fracturing will occur. However, if a weak direction exists within the specimen, the fracture would be expected to occur in this direction.

It has been demonstrated that the natural fracture system can be mapped in the subsurface so that both the orientation of the cleats and their directional flow paths can be utilized. Together with the advances made in drilling technology that permit the long horizontal boreholes to be drilled through the coal seam, sufficient channels will be created to sustain a gasification zone through the coalbed in predetermined directions. By using positive and negative pressured wells in a specific relationships to the face and butt cleats, directional control of movement of the combustion zone will result. This knowledge of underground directional control thus determines the appropriate well patterns to be established to produce a quality gas which can be used to generate electricity.

An advantageous aspect of the present invention resides in the combination of the system of the present invention with one or more electric generators. Preferably such generators are built in close proximity to the production wells to make maximum use of the fuel produced.

The burning of the coal will be incomplete — producing a gaseous fuel such as carbon monoxide or hydrogen rather than an incombustible product of combustion such as carbon dioxide or water. The carbon monoxide, hydrogen and other products of incomplete combustion will be drawn upwardly to the surface by a heat-resistant blower via a conduit or production well. That heat-resistant blower will move those products of incomplete combustion to a utilization area, where those components which are desirable as fuels will be separated from the rest of the components of the products of incomplete combustion and will be used to heat water in a boiler. The rest of the components of the products of incomplete combustion will be suitably treated to separate out from them any marketable compounds or compositions.

The boiler could be the boiler of any electric generating plant; and that electric generating plant would be erected close to the site. By locating the electric generating plant immediately adjacent the area, all of the shipping costs associated with combustible materials that are mined are avoided. Further, by locating the electric generating plant immediately adjacent the area, the gases which exhaust from that electric generating plant into the surrounding atmosphere are not immediately added to the air adjacent a large city. In addition, because the odor-producing and smoke-producing components developed by the process can be removed from the gaseous fuels before those gaseous fuels are burned under the boiler, the exhaust gases from the electric generating plant will contain fewer air pollutants than the exhaust gases from electric generating plants using solid fuels.

In the process of this invention a preferred method for controlling the temperature of the flame front and in addition, adjust the calorific value of the produced gas, is by the simultaneous injection of water with the combustion-supporting gas. A water gas shift reaction is thereby obtained at the site of the combustion front which yields a considerably enhanced calorific content produced gas and lowers the temperature of the combustion front. The temperature lowering results in a decreased loss of heat to the surroundings strata and a decrease in the destructive degradation of coal tar liquids. The increased hydrogen content of the resulting produced gas yields a high energy content energy source gas.

The following example is presented to illustrate the invention but it is not to be considered as limited thereto. Unless otherwise indicated, parts are by weight in the example and throughout the specification.

EXAMPLE

Core samples of coal are obtained from a coal field and subjected to examination to determine the orientation of the joints, the permeability, tensile strength, sonic velocity and inherent rock weakness as described hereinbefore. As a result, it is determined that the intervals or zones of weakness could be defined as lying at north 20° east and north 60° east. The permeability is determined to lie in the area of north 11° to 56° east. As a result, it is determined that three wells or boreholes are to be drilled. Two of the wells are drilled in a position such that the drill will be traveling in a direction at right angles to the indications of maximum permeability and orientation and from different directions. Each of the wells is started at a slant of 60° so as to intersect a coalbed which lays 450 feet below the surface. The intention is to gasify a block of coal 1000 feet long by 500 feet wide. An injection a well is drilled at each defined end of the coalbed until the drill intersects the bed after which casing etc. of the well in the normal matter is completed. A vertical production well is drilled into the coalbed for removal of the gas. The coalbed is then ignited from both injection wells and combustion supporting gas is introduced to maintain combustion of the coal bed. The combustion supporting gas used is air and is introduced in sufficient amount to maintain the combustion front from both sides of the coalbed. Water is injected with the combustion gas in order to maintain control of the temperature of the combustion front and to favorably influence the water gas shift reaction taking place.

The resulting gases of combustion are removed through the production well and are found to comprise a mixture of hydrogen, carbon monoxide, methane, carbon dioxide and oxygen. The combustible hydrogen, carbon monoxide and methane gases are separated from the remaining constituents and are suitable to power a steam turbine for the production of electricity.

The invention has been described herein with reference to certain preferred embodiments. However, as obvious variations thereon will appear to those skilled in the art, the invention is not to be considered as limited thereto.

What is claimed is:

1. A method for the in situ combustion of coal in a coalbed comprising:

determining the major natural fracture system of the coalbed;

drilling at least one well or borehole from the surface to intersect the coalbed while traveling in a horizontal direction and intersecting the major natural fracture system of the coalbed at a predetermined angle;

maintaining said well or borehole in said horizontal direction intersecting the major natural fracture system of the coalbed at said predetermined angle;

initiating burning of the coal while introducing a combustion supporting gas through said well or borehole to convert the coal in situ to a relatively high Btu gas; and recovering said relatively high Btu gas.

2. A method according to claim 1 wherein a horizontal production well or borehole is drilled into the coalbed to recover the produced gas.

3. A method according to claim 1 wherein the major natural fracture system of the coalbed is determined by removing core samples therefrom and testing to determine the fracture system orientation and the areas of maximum permeability.

4. A method according to claim 3 wherein the borehole or well is drilled at right angles to the major natural fracture system of the coalbed.

5. A method according to claim 3 wherein at least two boreholes or wells are drilled into opposite ends of the coalbed so as to intersect the coalbed in a horizontal direction.

6. A method according to claim 5 wherein the coalbed is Eastern coal wherein the major natural fracture system is the face cleats and the boreholes or wells are drilled at right angles thereto.

7. A method according to claim 5 wherein the combustion supporting gas is air or oxygen.

8. A method according to claim 7 wherein the gas recovered comprises a mixture of hydrogen, carbon monoxide, methane, carbon dioxide and oxygen.

9. A method according to claim 7 wherein the injection well or borehole is started at a slant from the surface at some angle from vertical and proceeds in a more horizontal direction until it intersects the coal while traveling in the horizontal direction.

10. A method according to claim 8 wherein the production gases recovered are subjected to separation to remove combustible gases suitable to produce electricity.

11. The method of claim 3 wherein the coalbed is Western coal and said at least one well or borehole is drilled at right angles to the natural fracture system.

12. The method of claim 5 wherein the coalbed is Western coal and the wells or boreholes are drilled at right angles to the natural fracture system.

* * * * *